US007503118B2

(12) United States Patent
Oh

(10) Patent No.: US 7,503,118 B2
(45) Date of Patent: Mar. 17, 2009

(54) HEAD-MOVING RAZOR

(76) Inventor: Tae-Jun Oh, Bupyeong 6-ri, Jingeop-eup, Namyangju-shi, 472-864, Gyeonggi-do (KR)

( * ) Notice: Subject to any disclaimer, the term of this patent is extended or adjusted under 35 U.S.C. 154(b) by 353 days.

(21) Appl. No.: 11/245,237

(22) Filed: Oct. 6, 2005

(65) Prior Publication Data

US 2006/0085983 A1 Apr. 27, 2006

(30) Foreign Application Priority Data

Oct. 8, 2004 (KR) ..... 10-2004-0080451

(51) Int. Cl.
*B26B 19/14* (2006.01)

(52) U.S. Cl. ..... 30/43.1; 30/43.4

(58) Field of Classification Search ..... 30/43.1, 30/43.3–43.6, 34.1
See application file for complete search history.

(56) References Cited

U.S. PATENT DOCUMENTS

| | | | | | |
|---|---|---|---|---|---|
| 926,509 | A * | 6/1909 | Rankin | 30/43.1 |
| 2,186,091 | A * | 1/1940 | Benner | 30/43.1 |
| 3,279,056 | A * | 10/1966 | Andis | 30/43.1 |
| 3,339,276 | A * | 9/1967 | Tolmie et al. | 30/43.1 |
| 3,797,109 | A * | 3/1974 | Yamada et al. | 30/43.1 |
| 3,945,115 | A * | 3/1976 | Daniels et al. | 30/43.1 |
| 4,776,095 | A * | 10/1988 | Tsujimoto et al. | 30/233 |
| 4,796,359 | A * | 1/1989 | Oprach et al. | 30/43.3 |
| 4,922,608 | A * | 5/1990 | Pahl | 30/43.1 |
| 4,930,217 | A * | 6/1990 | Wolf et al. | 30/43.1 |
| 4,941,259 | A * | 7/1990 | Wolf | 30/43.1 |
| 5,084,974 | A * | 2/1992 | Sukow et al. | 30/233 |
| 5,233,746 | A * | 8/1993 | Heintke | 30/43.1 |
| 5,687,481 | A * | 11/1997 | De Boer et al. | 30/43.1 |
| 6,243,952 | B1 * | 6/2001 | Holcomb et al. | 30/123.7 |
| 6,442,840 | B2 * | 9/2002 | Zucker | 30/43.6 |
| 6,931,731 | B2 * | 8/2005 | Izumi et al. | 30/43.1 |
| D528,700 | S * | 9/2006 | Oh | D28/49 |
| 2002/0011003 | A1 * | 1/2002 | Van Hout et al. | 30/34.1 |
| 2006/0085985 | A1 * | 4/2006 | Oh | 30/43.92 |

(Continued)

FOREIGN PATENT DOCUMENTS

JP 4269992 A 9/1992

(Continued)

*Primary Examiner*—Jason Daniel Prone
(74) *Attorney, Agent, or Firm*—Cantor Colburn LLP

(57) ABSTRACT

Disclosed herein is a head-moving razor having a movable head. The head-moving razor includes a head part, which has a drive motor and press blades, and a body part. The head part is movable relative to the body part. The body part is provided at the upper end thereof with a space part, which is defined between the upper surface of the body part and the lower surface of the head part. The upper surface of the body part is spaced a predetermined distance from the lower surface of the head part. The body part is also provided at the upper end thereof with supporting walls, which are protruded upward from the space part. The head part is attached to the supporting walls of the body part such that the head part can be moved a predetermined angular distance. The head part is smoothly moved a predetermined angular distance according to the movement of the hand of a user. Consequently, the cutting force of the head-moving razor is improved, and the smooth shaving operation of the head-moving razor is accomplished.

2 Claims, 7 Drawing Sheets

U.S. PATENT DOCUMENTS

2006/0218793 A1* 10/2006 Zucker ..... 30/43.4
2006/0283019 A1* 12/2006 Oh ..... 30/47
2007/0124937 A1* 6/2007 Oh ..... 30/43.92
2007/0124938 A1* 6/2007 Oh ..... 30/43.92
2008/0141537 A1* 6/2008 Oh ..... 30/42
2008/0250644 A1* 10/2008 Orloff et al. ..... 30/34.1

FOREIGN PATENT DOCUMENTS

JP 6343776 A 12/1994
JP 10043443 A 2/1998
WO 00/38891 7/2000

* cited by examiner

HEAD-MOVING RAZOR

BACKGROUND OF THE INVENTION

1. Field of the Invention

The present invention relates to a head-moving razor having a movable head, and, more particularly, to a head-moving razor including a head part, which has a drive motor and press blades, and a body part, the head part being movable relative to the body part, wherein the body part is provided at the upper end thereof with a space part, which is defined between the upper surface of the body part and the lower surface of the head part, the upper surface of the body part being spaced a predetermined distance from the lower surface of the head part, and the body part is also provided at the upper end thereof with supporting walls, which are protruded upward from the space part, the head part being attached to the supporting walls of the body part such that the head part can be moved a predetermined angular distance.

2. Description of the Related Art

A razor having a cradle shaving head is known as a conventional art, which is disclosed in Japanese Unexamined Patent Publication No. 6-343776. According to the disclosure of this publication, the cradle head, which has a shaving part mounted therein, is attached to the upper part of a grip part such that the cradle head can be pivoted in the thickness direction of the grip part.

A motor for driving an inner cutter of the shaving part is mounted at the lower end of the cradle head, and is protruded in the upper inner space of the grip part. Since the motor is pivoted along with the cradle head, it is required that the upper inner space of the grip part be wide enough to allow the motor to be pivoted. As a result, the grip part must be wide, which is an obstruction to manufacturing a razor having a size enough for a user to comfortably hold.

Another conventional art is disclosed in Japanese Unexamined Patent Publication No. 10-43443, which provides an electric razor including a cradle shaving head. The disclosed electric razor has a grip part, the width of which is considerably reduced, although a motor, which is pivoted along with the cradle head, is mounted in the grip part. However, the reduced width of the grip part limits the pivoting movement of the motor, and therefore, the pivoting movement of the cradle head is also limited. Consequently, the cradle head can be pivoted along the contour of the skin of a user only within a relatively small angular distance range.

Yet another conventional art is disclosed in Japanese Unexamined Patent Publication No. 4-269992, which provides an electric razor including a cradle shaving head, which has a shaving part mounted therein. The cradle shaving head is supported by a grip part such that the cradle shaving head can be pivoted about the pivot axis. In this conventional art, a motor for driving an inner cutter of the shaving part is mounted on the cradle head, and is protruded to the upper part of the grip part. Consequently, the angular distance range of the cradle head is restricted. Otherwise, the width of the grip part may be excessively increased.

International Patent Publication No. WO 00/38891 also discloses an electric razor including a cradle shaving head. According to the disclosed publication, the cradle head, in which a motor is mounted, is supported by the upper part of a grip part such that the cradle head can be pivoted about the pivot axis without interference with the grip part. However, the upper end of the cradle head, in which the motor is mounted, is supported by the grip part, and therefore, the pivot axis is formed above the center of gravity of the cradle head in the longitudinal direction of the razor. As a result, the grip part is uprightly erected, and therefore, a user does not need to raise his elbow. When a user assumes a comfortable manipulation posture, at which fatigue is not accumulated although the shaving operation is performed for a long period of time, the weight of the cradle head serves to maintain the neutral position of the cradle head. Specifically, the cradle head is pivoted about the axis when the razor is uprightly erected, and the opposite-side torque obstructs the pivoting movement of the cradle head. As a result, it is not easy to pivot the cradle head over a wide range. Furthermore, the user must uprightly erect the grip part and move the cradle head such that the cradle head runs across the skin of the user. Consequently, it is required that the user raise his elbow to shave his face such that the cradle is brought into smooth contact with several facial regions of the skin, and therefore, fatigue is accumulated.

This problem is caused by the conventional razors disclosed in the above-described three Japanese Unexamined Patent Publications. For this reason, it is required to proved an electric razor having a cradle head, which can be easily pivoted such that the cradle head is brought into wide and smooth contact with the skin of a user when a shaving operation is performed, whereby the user can vertically hold a grip part of the razor without excessively raising his elbow, and therefore, the user can perform the shaving operation.

SUMMARY OF THE INVENTION

Therefore, the present invention has been made in view of the above problems, and it is an object of the present invention to provide a head-moving razor having a movable head wherein the structure of the movable head is relatively simple, and the movable head is brought into wide and smooth contact with the skin of a user when the user performs a shaving operation.

In accordance with the present invention, the above and other objects can be accomplished by the provision of a head-moving razor including a head part, which has two press blades being rotated by a drive motor, and a body part, the head part being movable relative to the body part, wherein the body part is provided at the upper end thereof with a space part, which is defined between the upper surface of the body part and the lower surface of the head part, the upper surface of the body part being spaced a predetermined distance from the lower surface of the head part, and the body part is also provided at the upper end thereof with supporting walls, which are protruded upward from the space part, the head part being attached to the supporting walls of the body part such that the head part can be moved a predetermined angular distance.

Preferably, the two press blades are being rotated by a dual gear, which is rotated by a driving gear of the drive motor of the body part, a first driven gear, which is rotated by the dual gear, a second driven gear, which is rotated by the first driven gear, a third driven gear, which is rotated by the second driven gear, and rotating gears, which are fixed to the respective press blades and rotated by the third driven gear, and the dual gear, the first driven gear, and the second driven gear are disposed at one side of the body part, and the third driven gear and the rotating gears are disposed at one side of the head part, which corresponds to the side of the body part where the dual gear, the first driven gear, and the second driven gear are disposed.

Preferably, the head part has a connection shaft protruded outward therefrom and inserted in the corresponding supporting wall, which is formed at one side of the body part, and a pinion fixedly fitted on the connection shaft, and the body part has a rack connected to the pinion, the rack being vertically moved a predetermined distance by the vertical movement of a moving switch, which is attached to the outside of the body part, such that the pinion is rotated a predetermined angle, whereby the head part is angularly moved.

Preferably, the angular movement of the head part is controlled by the operation of a rack and pinion unit, which is performed by the vertical movement of a moving switch disposed at the body part.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
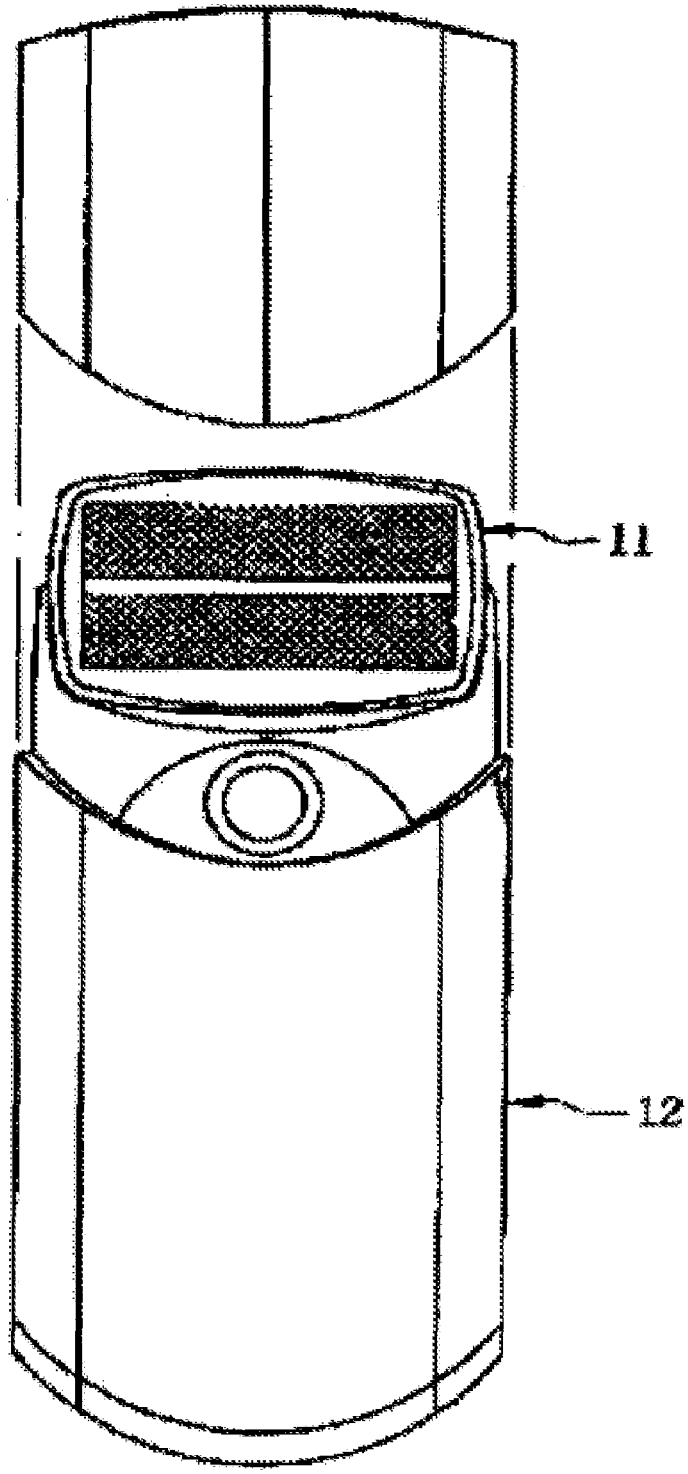
FIG. 1 is a front view illustrating a head-moving razor according to the present invention.
Figure 2:
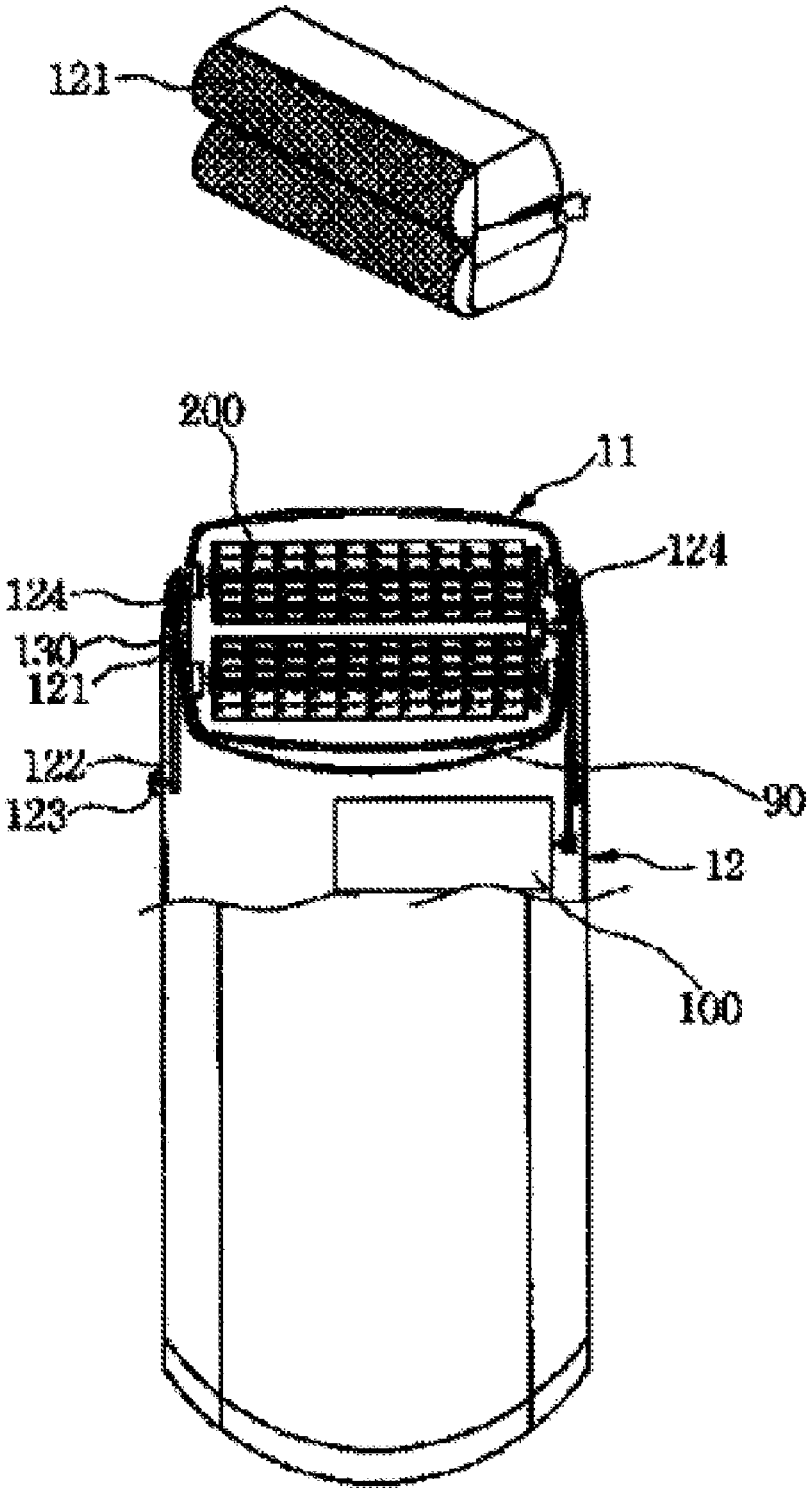
FIG. 2 is a front view, partially in section, schematically illustrating the structure of a head part of the head-moving razor according to the present invention, including a perspective view of the head part.
Figure 3:
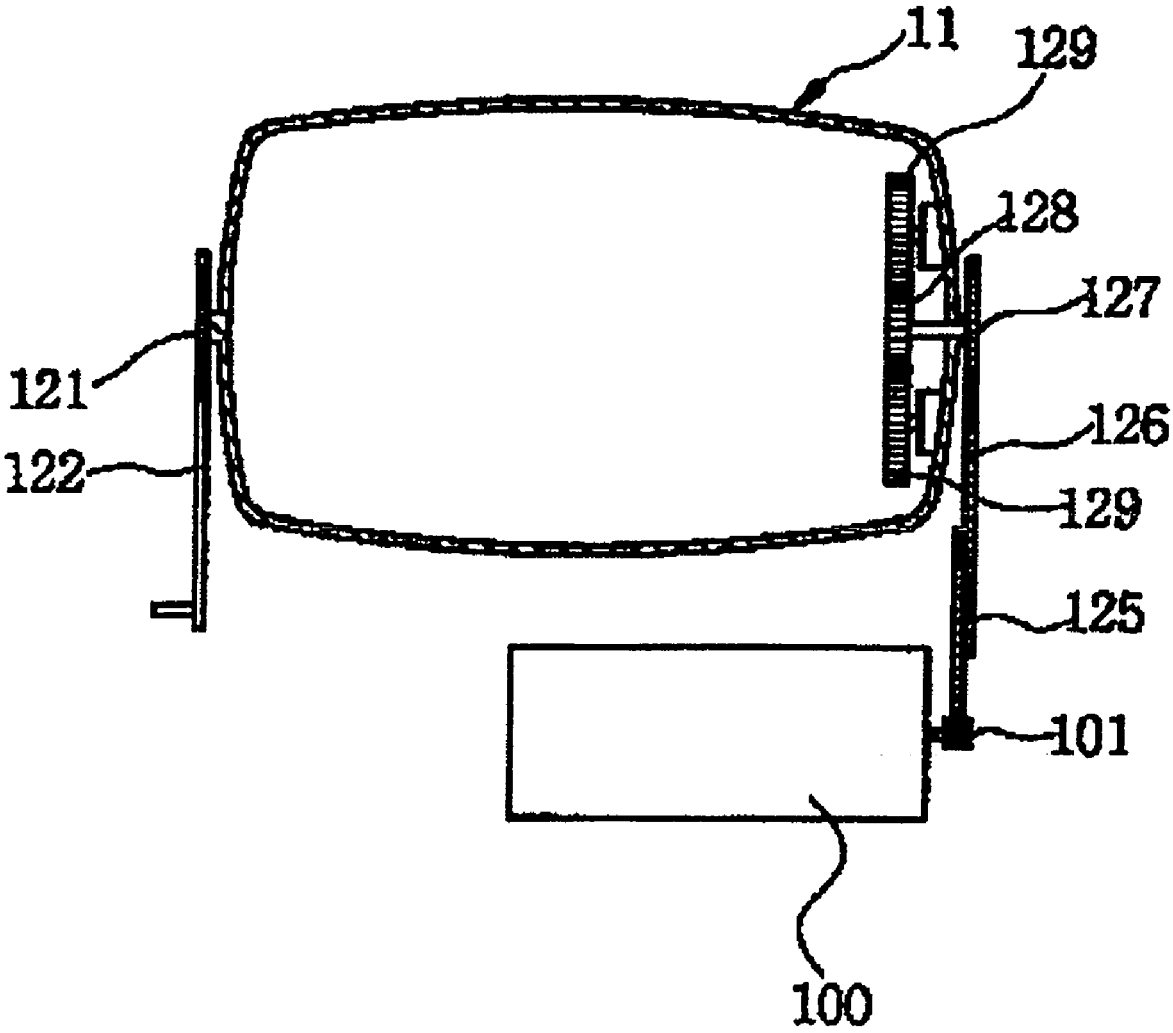
FIG. 3 is a sectional view illustrating the drive structure of the head-moving razor according to the present invention.
Figure 4:
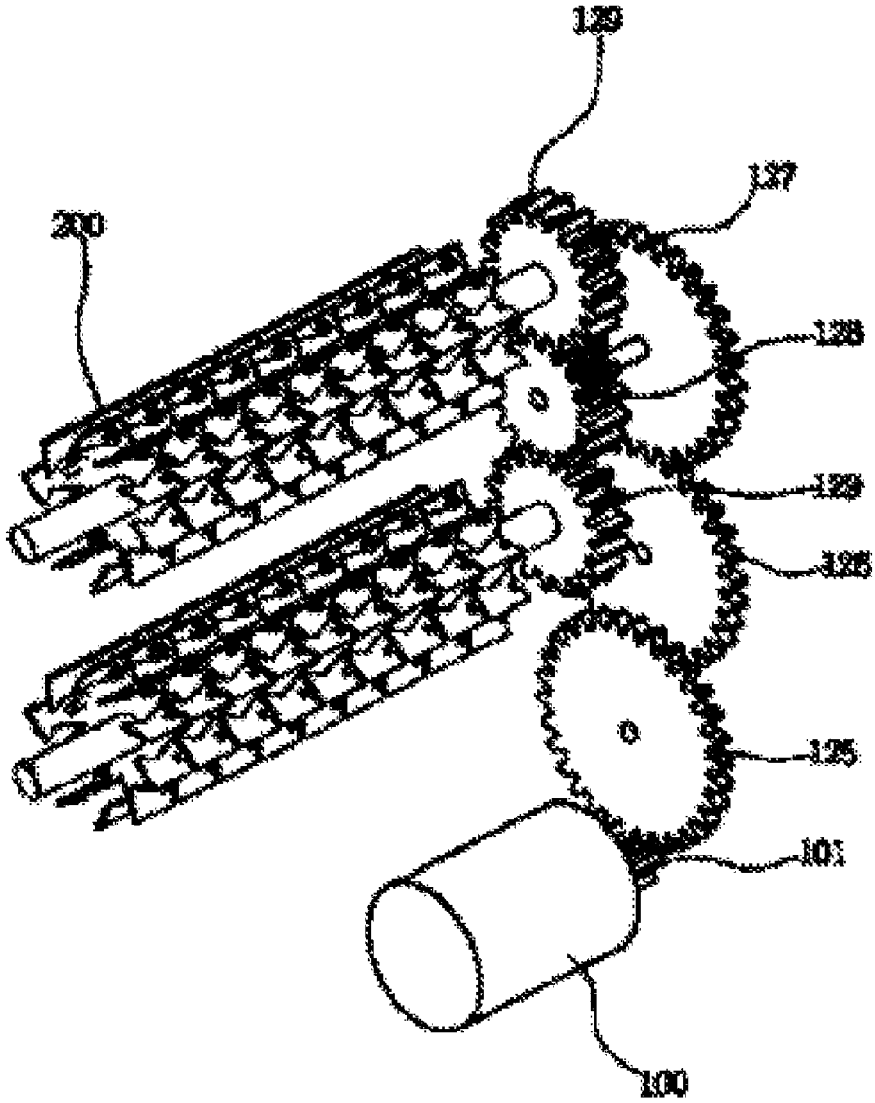
FIG. 4 is a perspective view illustrating, in detail, components constituting the drive structure of the head-moving razor according to the present invention.
Figure 5:
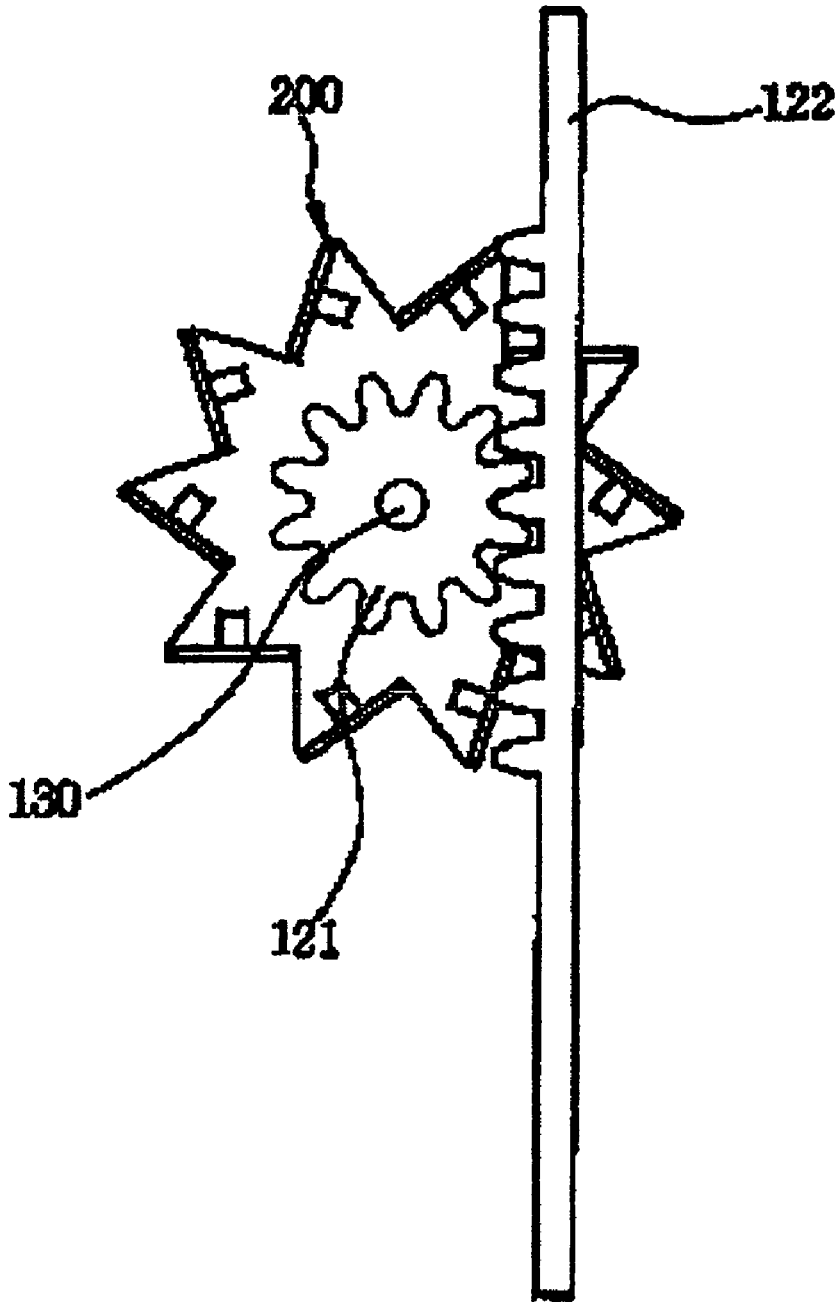
FIG. 5 is a view illustrating a drive unit for angularly moving the head part of the head-moving razor according to a preferred embodiment of the present invention.
Figure 6:
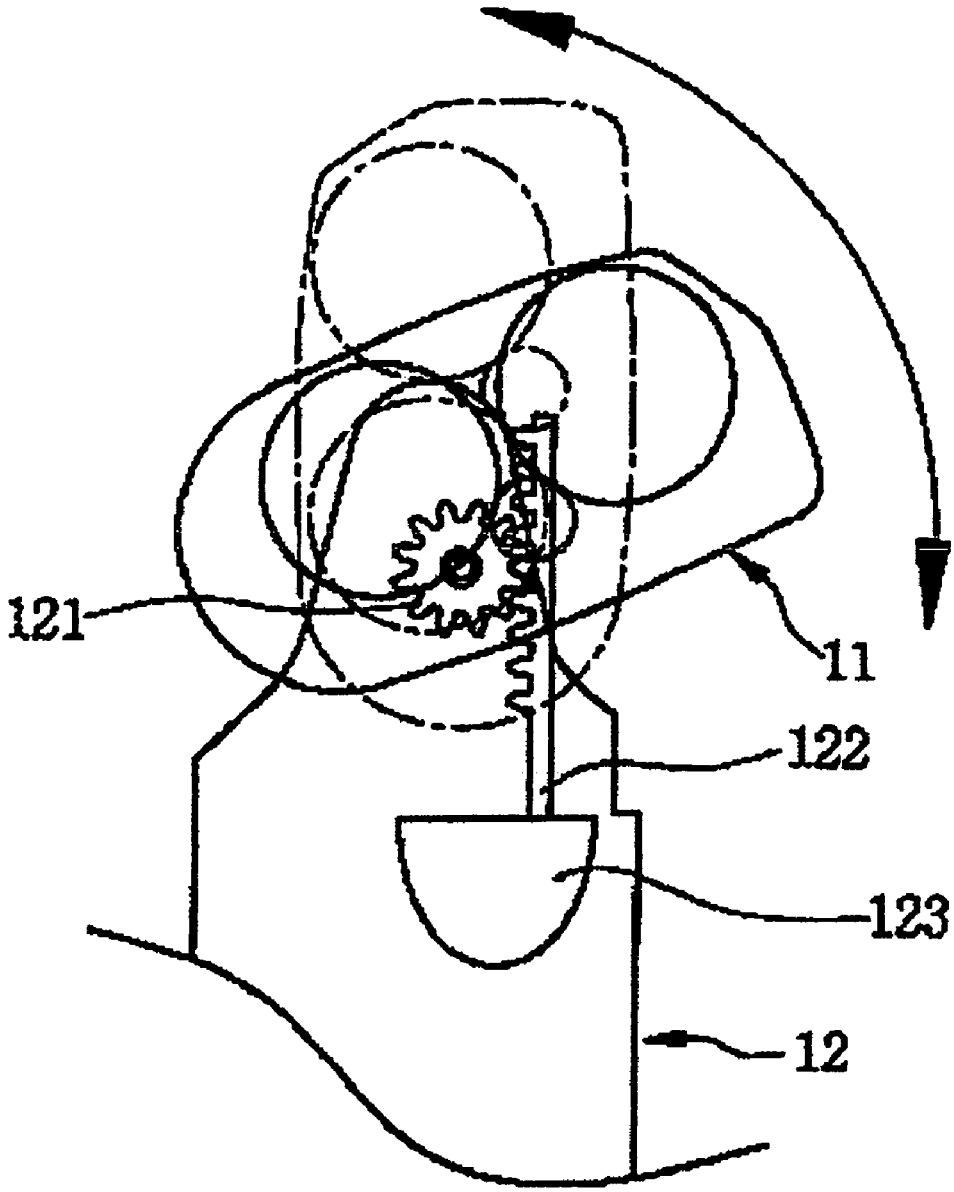
FIG. 6 is a view illustrating a drive unit for angularly moving the head part of the head-moving razor according to another preferred embodiment of the present invention.
Figure 7:
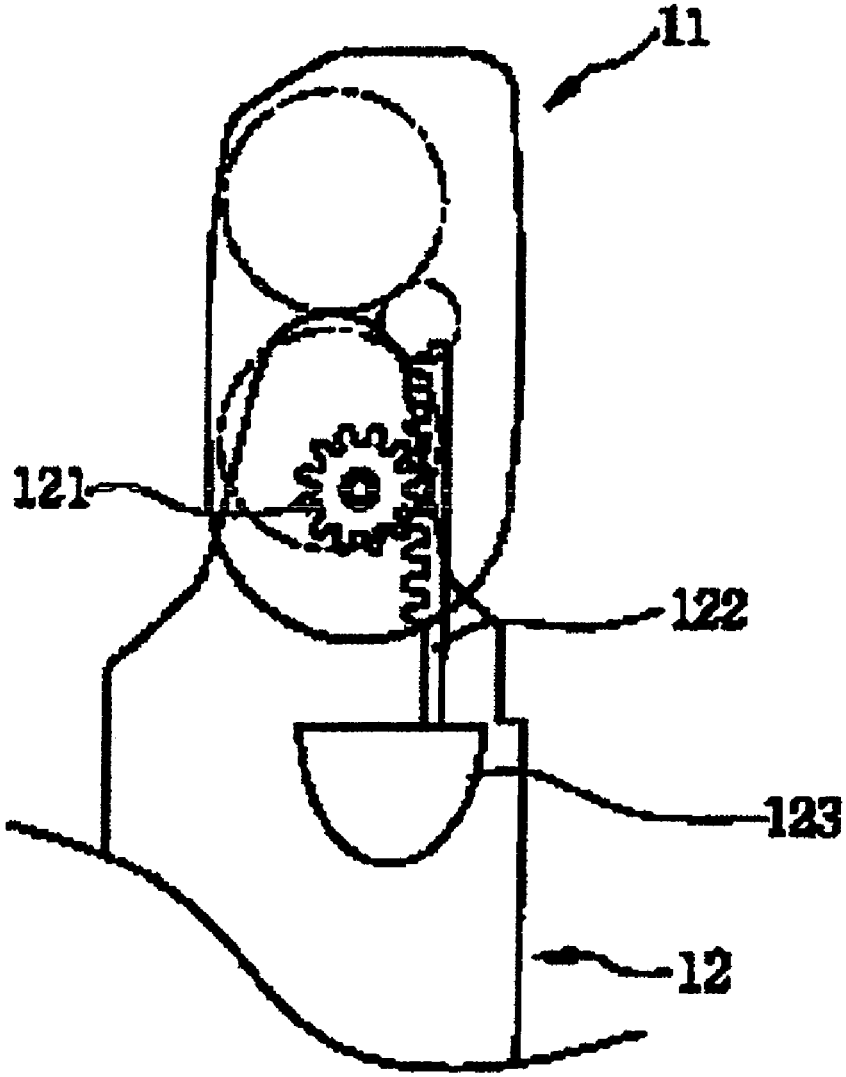
FIG. 7 is a view illustrating a drive unit for angularly moving the head part of the head-moving razor according to yet another preferred embodiment of the present invention.

FIG. 1 is a front view illustrating a head-moving razor according to the present invention, FIG. 2 is a front view, partially in section, schematically illustrating the structure of a head part of the head-moving razor according to the present invention, including a perspective view of the head part, FIG. 3 is a sectional view illustrating the drive structure of the head-moving razor according to the present invention, FIG. 4 is a perspective view illustrating, in detail, components constituting the drive structure of the head-moving razor according to the present invention, FIG. 5 is a view illustrating a drive unit for angularly moving the head part of the head-moving razor according to a preferred embodiment of the present invention, FIG. 6 is a view illustrating a drive unit for angularly moving the head part of the head-moving razor according to another preferred embodiment of the present invention, and FIG. 7 is a view illustrating a drive unit for angularly moving the head part of the head-moving razor according to yet another preferred embodiment of the present invention.

Referring first to FIGS. 1 and 2, the head-moving razor according to the present invention includes a head part 11, which has two press blades 200 being rotated by a drive motor 100. The head part 11 is movable relative to a body part 12. The body part 12 is provided at the upper end thereof with a space part 90, which is defined between the upper surface of the body part 12 and the lower surface of the head part 11. The upper surface of the body part 12 is spaced a predetermined distance from the lower surface of the head part 11. The body part 12 is also provided at the upper end thereof with supporting walls 124, which are protruded upward from the space part 90. The head part 11 is attached to the supporting walls 124 of the body part 12 such that the head part 11 can be moved a predetermined angular distance.

Specifically, the supporting walls 124 are formed at opposite sides of the upper end of the body part 12, and the head part 11 is fitted in the upper end of the body part 12 while the head part 11 is attached to the opposite supporting walls 124 of the bay part 12 such that the angular movement of the head part 11 can be manually accomplished in the upper end of the body part 12.

The press blades 200 are rotated by a dual gear 125, which is rotated by a driving gear 101 of the drive motor 100 of the body part 12, a first driven gear 126, which is rotated by the dual gear 125, a second driven gear 127, which is rotated by the first driven gear 126, a third driven gear 128, which is rotated by the second driven gear 127, and rotating gears 129, which are fixed to the respective press blades 200 and rotated by the third driven gear 128. The dual gear 125, the first driven gear 126, and the second driven gear 127 are disposed at one side of the body part 12, and the third driven gear 128 and the rotating gears 129 are disposed at one side of the head part 11, which corresponds to the side of the body part 12 where the dual gear 125, the first driven gear 126, and the second driven gear 127 are disposed.

The head part 11 is angularly moved by a rack and pinion structure, which is mounted at one side of the body part 12 in addition to manual movement of the head part 11.

Specifically, a connection shaft 130, which is protruded outward from the head part 11, is inserted in the corresponding supporting wall 124, which is formed at the other side of the body part 12. A pinion 121 is fixedly fitted on the connection shaft 130, and a rack 122 is connected to the pinion 121. The rack 122 is vertically moved a predetermined distance by the vertical movement of a moving switch 123, which is attached to the outside of the body part 12, and therefore, the pinion 121 is rotated a predetermined angle. As a result, the head part 11 is angularly moved.

Meanwhile, the angular movement of the head part 12 is controlled by the operation of the rack and pinion unit 122 and 121, which is performed by the vertical movement of the moving switch 123 of the body part 12.

As apparent from the above description, a shaving operation can be performed using the head-moving razor according to the present invention while the head part is angularly moved by manipulating the moving switch mounted at one side of the body part and connected to the rack and pinion unit. Furthermore, the shaving operation can be performed while the head part is manually moved. Consequently, the present invention has the effect of improving the cutting force of the head-moving razor. Furthermore, the present invention has the effect of enabling a smooth shaving operation, and therefore, preventing damage to the skin of a user of the head-moving razor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A head-moving razor including a head part having two press blades being rotated by a drive motor, and a body part, the head part being movable relative to the body part, wherein the body part is provided at an upper end thereof with a space part, which is defined between an upper surface of the body part and a lower surface of the head part, the upper surface of the body part being spaced a predetermined distance from the lower surface of the head part, and the body part is also provided at the upper end thereof with supporting walls, which are protruded upward from the space part, the head part being attached to the supporting walls of the body part such that the head part can be moved a predetermined angular distance; and wherein the head part has a connection shaft protruded outward therefrom and inserted in the corresponding supporting walls, which is formed at one side of the body part, and a pinion fixedly fitted on the connection shaft, and the body part has a rack connected to the pinion, the rack being vertically moved a predetermined distance by the vertical movement of a moving switch, which is attached to the outside of the body part, such that the pinion is rotated a predetermined angle, whereby the head part is angularly moved.

2. The razor as set forth in claim 1, wherein the two press blades are rotated by a dual gear, which is rotated by a driving gear of the drive motor of the body part, a first driven gear, which is rotated by the dual gear, a second driven gear, which is rotated by the first driven gear, a third driven gear, which is rotated by the second driven gear, and rotating gears, which are fixed to the respective press blades and rotated by the third driven gear, and the dual gear, the first driven gear, and the second driven gear are disposed at one side of the body part, and the third driven gear and the rotating gears are disposed at one side of the head part, which corresponds to the side of the body part where the dual gear, the first driven gear, and the second driven gear are disposed.

* * * * *